US010486939B2

(12) United States Patent
Kuczek et al.

(10) Patent No.: US 10,486,939 B2
(45) Date of Patent: Nov. 26, 2019

(54) BREAKING SYSTEM FOR A HOISTED STRUCTURE AND METHOD OF CONTROLLING BRAKING A HOISTED STRUCTURE

(71) Applicant: OTIS ELEVATOR COMPANY, Farmington, CT (US)

(72) Inventors: Andrzej Ernest Kuczek, Bristol, CT (US); Enrico Manes, Feeding Hills, MA (US); Joseph C. Rampone, Colchester, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 438 days.

(21) Appl. No.: 15/265,963

(22) Filed: Sep. 15, 2016

(65) Prior Publication Data

US 2017/0088398 A1 Mar. 30, 2017

Related U.S. Application Data

(60) Provisional application No. 62/233,370, filed on Sep. 27, 2015.

(51) Int. Cl.
*B66B 5/22* (2006.01)
*B66B 5/04* (2006.01)
(Continued)

(52) U.S. Cl.
CPC ..... *B66B 5/22* (2013.01); *B66B 5/044* (2013.01); *B66B 5/18* (2013.01); *B66B 9/00* (2013.01); *B66B 9/003* (2013.01); *B66B 11/0407* (2013.01)

(58) Field of Classification Search
CPC ..... B66B 5/22; B66B 5/18; B66B 5/044
See application file for complete search history.

(56) References Cited

U.S. PATENT DOCUMENTS 5,363,942 A 11/1994 Osada
5,366,045 A 11/1994 Liston
(Continued)

FOREIGN PATENT DOCUMENTS

CN 86208740 U 8/1987
DE 102005045114 A1 4/2007
(Continued)

OTHER PUBLICATIONS

English Machine Translation of DE 10 2005 045 114 Sep. 2005.*
(Continued)

*Primary Examiner* — Diem M Tran
(74) *Attorney, Agent, or Firm* — Cantor & Colburn LLP

(57) ABSTRACT

A braking system for a hoisted structure guided along a guide rail is provided. The braking system includes a brake member for coupling to the hoisted structure and having a brake surface configured to frictionally engage the guide rail, the brake member moveable between a braking position and a non-braking position. Further included is a brake member actuation mechanism operatively coupled to the brake member and configured to actuate the brake member from the non-braking position to the braking position, the brake member actuation mechanism remaining coupled to the brake member in the braking position to control the braking force applied on the hoisted structure by the frictional engagement between the guide rail and the brake member.

11 Claims, 4 Drawing Sheets

(51) Int. Cl.

| | |
|---|---|
| ***B66B 5/18*** | (2006.01) |
| ***B66B 9/00*** | (2006.01) |
| ***B66B 11/04*** | (2006.01) |

(56) References Cited

U.S. PATENT DOCUMENTS

| | | | | |
|---|---|---|---|---|
| 6,371,261 | B1 | 4/2002 | Thompson et al. | |
| 6,719,101 | B2 * | 4/2004 | Hugel | B66B 5/22 187/372 |
| 7,575,099 | B2 * | 8/2009 | Oh | B66B 5/06 187/247 |
| 2002/0117357 | A1 | 8/2002 | Hugel | |
| 2007/0051563 | A1 | 3/2007 | Oh | |
| 2013/0081908 | A1 | 4/2013 | Meierhans | |
| 2014/0008157 | A1 | 1/2014 | Terry et al. | |
| 2015/0353321 | A1 * | 12/2015 | Fargo | B66B 1/285 187/276 |
| 2016/0289045 | A1 * | 10/2016 | Osmanbasic | B66B 5/22 |

FOREIGN PATENT DOCUMENTS

| | | | |
|---|---|---|---|
| EP | 2881353 | A1 | 6/2015 |
| GB | 191403955 | A | 7/1914 |
| JP | H03018577 | | 1/1991 |
| WO | 2014075954 | A1 | 5/2014 |
| WO | 2014200122 | A1 | 12/2014 |
| WO | 2015071188 | A1 | 5/2015 |

OTHER PUBLICATIONS

Search Report regarding related EP App. No. 16190874.4; dated Feb. 13, 2017; 7 pgs.

Chinese First Office Action for application 201610853361.X, dated Oct. 10, 2019, 6 pages.

* cited by examiner

BREAKING SYSTEM FOR A HOISTED STRUCTURE AND METHOD OF CONTROLLING BRAKING A HOISTED STRUCTURE

CROSS-REFERENCE TO RELATED APPLICATION

This patent application claims priority to U.S. Provisional patent Application Ser. No. 62/233,370, filed Sep. 27, 2015, which is incorporated herein by reference in its entirety.

BACKGROUND OF THE DISCLOSURE

The embodiments herein relate to braking systems and, more particularly, to controlling braking of a hoisted structure.

Hoisting systems, such as elevator systems, for example, often include a hoisted structure (e.g., elevator car), a counterweight, a tension member (e.g., rope, belt, cable, etc.) that connects the hoisted structure and the counterweight. During operation of such systems, a safety braking system is configured to assist in braking the hoisted structure relative to a guide member, such as a guide rail, in the event the hoisted structure exceeds a predetermined velocity or acceleration.

Prior attempts to actuate a braking device typically require a mechanism that includes a governor, a governor rope, a tension device and a safety actuation module. The safety actuation module comprises lift rods and linkages to actuate the safeties, also referred to as a braking device. Reducing, simplifying or eliminating components of this mechanism, while providing a reliable and stable braking of the hoisted structure, would prove advantageous.

In addition to the issues described above, current safety braking assemblies are semi-passive systems which undesirably fail to provide control over the amount of the braking force applied during a braking event.

BRIEF DESCRIPTION OF THE DISCLOSURE

According to one embodiment, a braking system for a hoisted structure guided along a guide rail is provided. The braking system includes a brake member for coupling to the hoisted structure and having a brake surface configured to frictionally engage the guide rail, the brake member moveable between a braking position and a non-braking position. Further included is a brake member actuation mechanism operatively coupled to the brake member and configured to actuate the brake member from the non-braking position to the braking position, the brake member actuation mechanism remaining coupled to the brake member in the braking position to control the braking force applied on the hoisted structure by the frictional engagement between the guide rail and the brake member.

In addition to one or more of the features described above, or as an alternative, further embodiments may include that the brake member actuation mechanism comprises a solenoid operatively coupled to the brake member with a biasing member.

In addition to one or more of the features described above, or as an alternative, further embodiments may include that the brake member is operatively coupled to the brake member with a coupling spring.

In addition to one or more of the features described above, or as an alternative, further embodiments may include that the brake member actuation mechanism is disposed in sliding contact with the guide rail.

In addition to one or more of the features described above, or as an alternative, further embodiments may include that the brake member actuation mechanism is biased into contact with the guide rail with a biasing spring.

In addition to one or more of the features described above, or as an alternative, further embodiments may include that an electric current provided to the solenoid controls the controls the deceleration of the hoisted structure based on control of the braking force applied.

In addition to one or more of the features described above, or as an alternative, further embodiments may include that the brake member actuation mechanism comprises an electromechanical actuator operatively coupled to the brake member with a release link device.

In addition to one or more of the features described above, or as an alternative, further embodiments may include a coupling spring disposed between the brake member and a frame structure disposed proximate the electromechanical actuator.

In addition to one or more of the features described above, or as an alternative, further embodiments may include that the electromechanical actuator is in operative communication with a speed monitoring device configured to detect an overspeed condition of the hoisted structure.

In addition to one or more of the features described above, or as an alternative, further embodiments may include that the speed monitoring device comprises at least one of an optical sensor and an accelerometer, wherein the brake member actuation mechanism actuates the brake member upon detection of the overspeed condition.

In addition to one or more of the features described above, or as an alternative, further embodiments may include a biasing spring surrounding at least a portion of the release link device.

In addition to one or more of the features described above, or as an alternative, further embodiments may include that the brake member comprises a moveable wedge member disposed between the guide rail and a fixed wedge member, wherein the moveable wedge member and the fixed wedge member each comprise an angled surface disposed in close proximity to each other and oriented at complementary angles.

In addition to one or more of the features described above, or as an alternative, further embodiments may include that the angled surface of the moveable wedge member comprises 20 degrees.

In addition to one or more of the features described above, or as an alternative, further embodiments may include a plurality of wedge rollers disposed between the moveable wedge member and the fixed wedge member According to another embodiment, a method of controlling braking for a hoisted structure guided along a guide rail is provided. The method includes detecting an overspeed condition of the hoisted structure. The method also includes actuating a brake wedge to engage the guide rail with a brake member actuation mechanism. The method further includes actively controlling a brake force generated by frictional engagement of the brake wedge and the guide rail by maintaining a coupling between the brake wedge and the brake member actuation mechanism.

BRIEF DESCRIPTION OF THE DRAWINGS

The subject matter which is regarded as the disclosure is particularly pointed out and distinctly claimed in the claims at the conclusion of the specification. The foregoing and other features and advantages of the disclosure are apparent from the following detailed description taken in conjunction with the accompanying drawings in which:

DETAILED DESCRIPTION OF THE DISCLOSURE

With reference to the Figures, embodiments of a braking system for a hoisted structure are provided herein. The hoisted structure refers to an elevator operating within an elevator system in some embodiments, but it is to be appreciated that any type of hoisted structure may benefit from the embodiments disclosed herein. In the context of an elevator system, it is to be understood that a variety of elevator systems are contemplated to benefit from the embodiments of the braking system disclosed herein.

Figure 1:
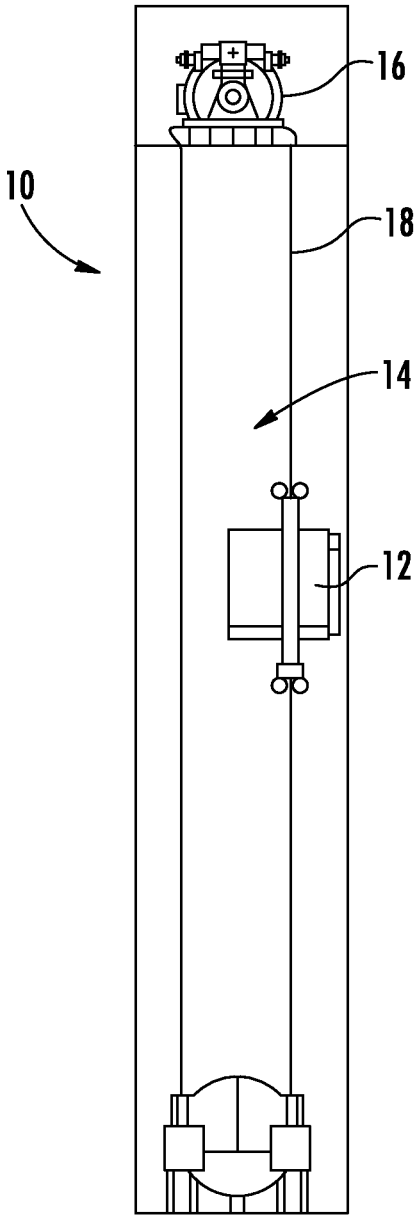
FIG. 1 is a schematic illustration of an elevator system according to a first embodiment.

In some embodiments, an elevator system 10 includes a tension member, such as a rope, cable or the like, as shown in FIG. 1. The elevator system 10 includes an elevator car 12 that is disposed within an elevator shaft 14 and is moveable therein, typically in a vertical manner. A drive system 16 includes a motor and brake and is conventionally used to control the vertical movements of the elevator car 12 along the elevator shaft 14 via a traction system that includes cables, belts or the like 18 and at least one pulley.

Figure 2:
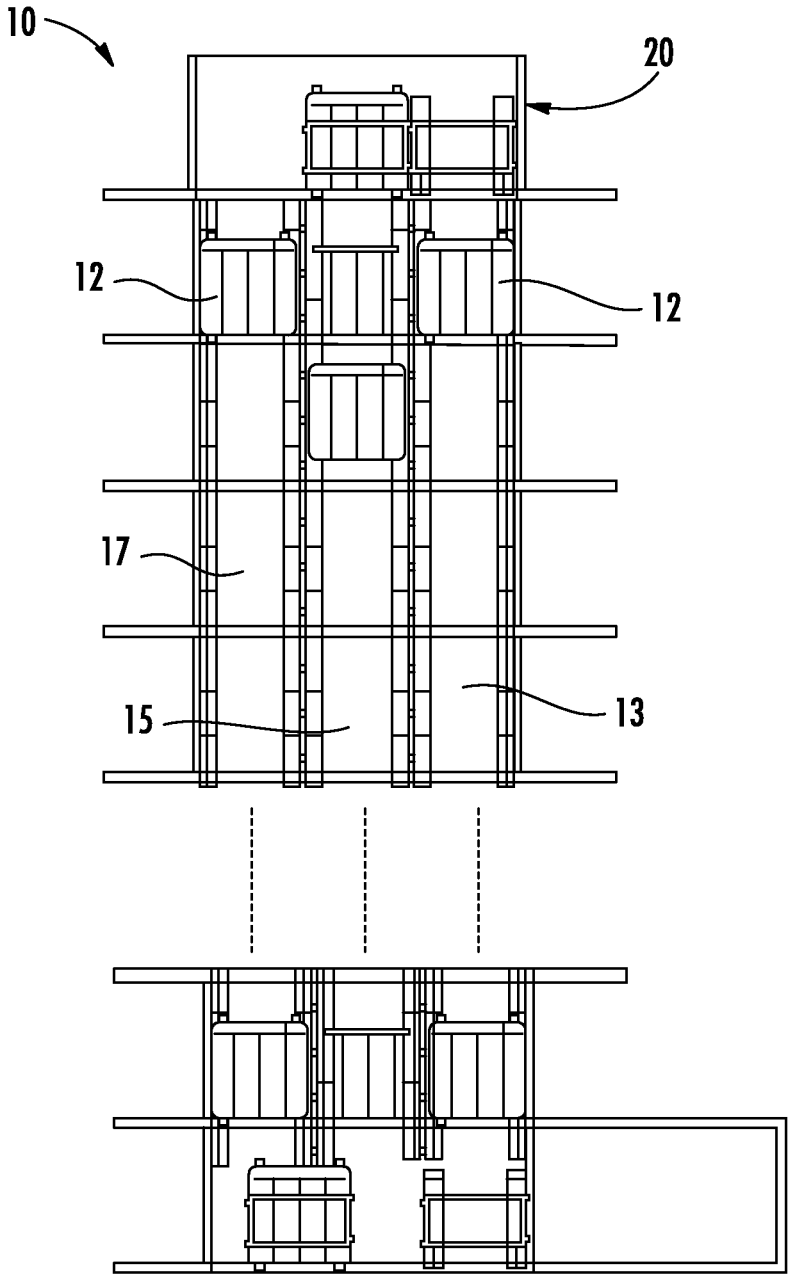
FIG. 2 is a schematic illustration of the elevator system according to a second embodiment.

Referring now to FIG. 2, alternatively the elevator system 10 may be referred to as a "ropeless" elevator system. FIG. 2 depicts a multicar, ropeless elevator system according to an exemplary embodiment. The elevator system 10 includes a hoistway 20 having a plurality of lanes 13, 15 and 17. In an embodiment, the elevator system 10 includes modular components that can be associated to form an elevator system. Modular components include, but are not limited to a landing floor hoistway, a shuttle floor hoistway, a transfer station, a carriage, a parking area, a disengaging mechanism, etc. While three lanes are shown in FIG. 2, it is understood that embodiments may be used with multicar, ropeless elevator systems having any number of lanes. In each lane 13, 15, 17, elevator cars 12 travel in mostly one direction, i.e., up or down. For example, in FIG. 2, cars 12 in lanes 13 and 17 travel up and cars 12 in lane 15 travel down. One or more cars 12 may travel in a single lane 13, 15, and 17. In an embodiment, cars 12 can move bi-directionally within lanes 13, 15, 17. In an embodiment, lanes 13, 15, 17 can support shuttle functionality during certain times of the day, such as peak hours, allowing unidirectional, selective stopping, or switchable directionality as required. In an embodiment, lanes 13, 15, 17 can include localized directionality, wherein certain areas of lanes 13, 15, 17 and hoistway 20 are assigned to various functions and building portions. In an embodiment, cars 12 can circulate in a limited area of hoistway 20. In an embodiment, cars 12 can operate at a reduced velocity to reduce operating and equipment costs. In other embodiments, hoistway 20 and lanes 13, 15, 17 can operate in a mixed mode operation wherein portions of hoistway 20 and lanes 13, 15, 17 operate normally (unidirectional or bidirectional) and other portions operate in another manner, including but not limited to, unidirectional, bidirectional, or in a parking mode. In an embodiment, parked cars can be parked in lanes 13, 15, 17 when lanes are designated for parking.

Figure 3:
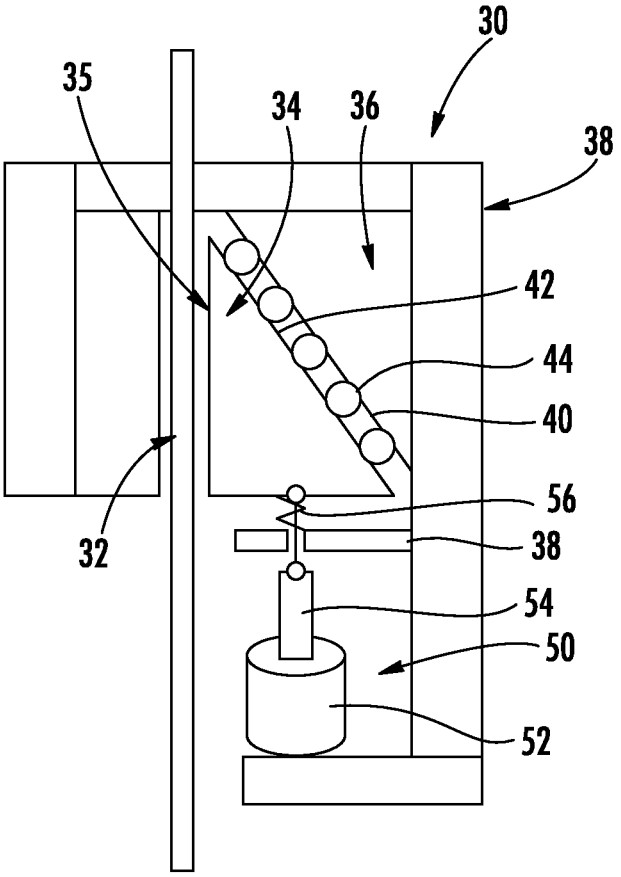
FIG. 3 is a schematic illustration of a braking system for a hoisted structure according to an aspect of the disclosure.

Referring to FIG. 3, irrespective of the particular type of elevator system that the braking system is employed with, the braking system is configured to controllably apply a braking force to decelerate, stop and hold the elevator car 12 relative to a guide member. The braking system is referred to generally with numeral 30 and is described in detail herein.

According to the embodiment illustrated in FIG. 3, a first embodiment of the brake system 30 is illustrated. The guide member that guides the elevator car 12 is referred to herein as a guide rail 32 and is connected to a structural feature of the elevator system 10, such as a wall of the elevator car passage and is configured to guide the hoisted structure, typically in a vertical manner. The guide rail 32 may be formed of numerous suitable materials, typically a durable metal, such as steel, for example.

The braking system 30 includes a brake member 34 that includes a contact surface 35 that is operable to frictionally engage the guide rail 32. The brake member 34 is moveable between a non-braking position and a braking position. The non-braking position is a position that the brake member 34 is disposed in during normal operation of the hoisted structure. In particular, the brake member 34 is not in contact with the guide rail 32 while the brake member 34 is in the non-braking position, and thus does not frictionally engage the guide rail 32.

The brake system 30 includes a fixed member 36 that is mounted to a frame 38 of the elevator car 12. The fixed member 36 allows translation of the brake member 34 relative thereto. Subsequent to translation of the brake member 34, the brake member 34 is in contact with the guide rail 32, thereby frictionally engaging the guide rail 32. The fixed member 36 includes a tapered wall 40 and the brake member 34 is formed in a wedge-like configuration that drives the brake member 34 into contact with the guide rail 32 during movement from the non-braking position to the braking position. The wedge-like configuration of the brake member 34 includes a tapered wall 42 that substantially corresponds to the tapered wall 40 of the fixed member 36. The tapered walls 40, 42 are oriented at an angle that facilitates complete mechanical advantage of the wedging force, but does not allow for jamming or binding of the braking system 30. In one example, the angle is about 20 degrees relative to vertical. One or more components 44 may be disposed between the tapered walls 40, 42 to facilitate sliding of the brake member 34. In the illustrated embodiment, the one or more components are rollers, but it is to be appreciated that alternative structures may be employed.

In the braking position, the frictional force between the contact surface 35 of the brake member 34 and the guide rail 32 is sufficient to stop movement of the hoisted structure relative to the guide rail 32. Although a single brake member is illustrated and described herein, it is to be appreciated that more than one brake member may be included. For example, a second brake member may be positioned on an opposite side of the guide rail 32 from that of the brake member 34, such that the brake members work in conjunction to effect braking of the hoisted structure.

The brake system 30 also includes a brake member actuation mechanism 50. The brake member actuation mechanism 50 is selectively operable to actuate movement of the brake member 34 from the non-braking position to the braking position. More particularly, the brake member actuation mechanism 50 applies a small force to initiate movement of the brake member 34, but also to fully control the braking and/or holding force resulting from frictional engagement between the guide rail 32 and the brake member 34. To facilitate such control with the brake member actuation mechanism 50, the mechanism 50 remains in contact (e.g., coupled) with the brake member 34 even subsequent to actuation of the brake member 34 (i.e., when brake member is in braking position).

In the illustrated embodiment, the brake member actuation mechanism 50 comprises an electromechanical actuator 52 that is operatively coupled to the frame 38 of the elevator car 12. A link device 54 is operatively coupled to the electromechanical actuator 52 and extends toward, and into contact with, the brake member 34. The link device 54 imparts a force on the brake member 34 upon initiation by the electromechanical actuator 52. The link device 54 remains coupled to the brake member 54 at all times and is configured to release the brake member 34 from frictional contact by exerting a force on the brake member 34 that pulls the brake member downwards to allow a simple and quick transition from the braking position to the non-braking position. This process reduces or eliminates the need to mechanically lift the elevator car 12 to release the brake member 34. A spring 56 operatively coupled to the brake member 34 at one end and to the frame 38 at the other end is included in some embodiments to further this effort.

In operation, an electronic sensor and/or control system (not illustrated) is configured to monitor various parameters and conditions of the hoisted structure and to compare the monitored parameters and conditions to at least one predetermined condition. In one embodiment, the predetermined condition comprises velocity and/or acceleration of the hoisted structure. In the event that the monitored condition (e.g., over-speed, over-acceleration, etc.) exceeds the predetermined condition, the brake member actuator mechanism 50 is actuated to initiate movement of the brake actuator 34 into engagement with the guide rail 32. The device used to detect the monitored condition may vary. For example, the device may be an optical sensor or an accelerometer.

Figure 4:
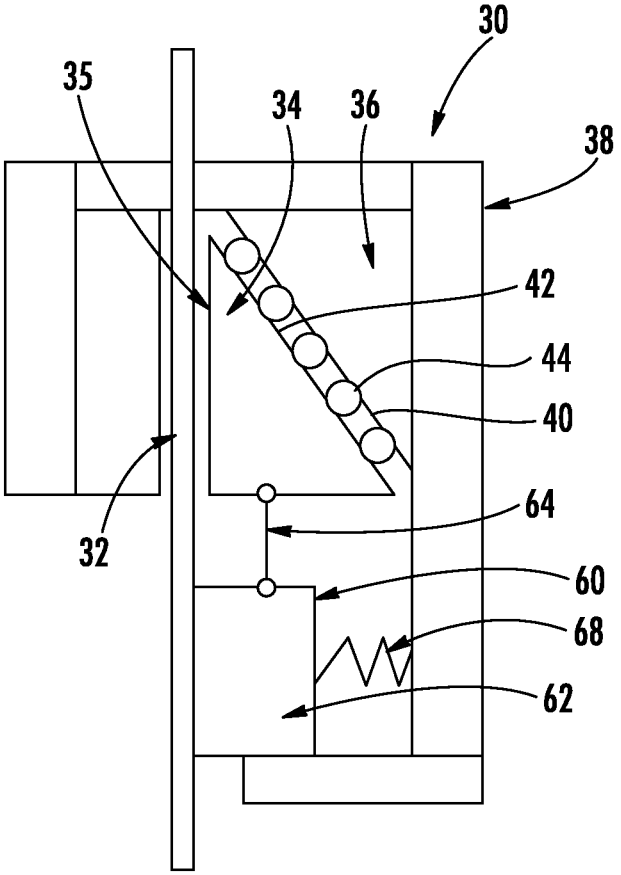
FIG. 4 is a schematic illustration of the braking system according to another aspect of the disclosure.

Referring now to FIG. 4, another embodiment of the brake member actuation mechanism is illustrated and is referred to generally with numeral 60. The brake member actuation mechanism 60 comprises a solenoid 62 that is disposed proximate the guide rail 32. In some embodiments, the solenoid 62 is disposed in sliding contact with the guide rail 32. To maintain contact between the solenoid 62 and the guide rail 32, a biasing spring 68 is operatively coupled at one end to the solenoid 62 and at the other end to the frame 38 of the elevator car 12.

The solenoid 62 is operatively coupled to the brake member 34 with a link member 64, such as a coupling spring 70 disposed in compression or tension. As the solenoid 62 slides along the guide rail 32, a drag force is generated and provides an actuation force that is controlled by an electric current provided to the solenoid 62. Upon reaching a predetermined force, actuation of the brake member 34 is made and movement to the braking position is achieved. The electric current provided to the solenoid 62 controls the deceleration and holding force of the elevator car 12.

In addition to the embodiments described above, braking may be actuated with pneumatics, hydraulics, and pyrotechnics, for example.

The embodiments described herein advantageously provide a braking system 30 that actuates the brake member 34, but also controls the braking force applied. By fully controlling the braking force, integration of safety and holding brakes reduce cot and weight as well as add simplicity to the overall system.

While the disclosure has been described in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

The invention claimed is:

1. A braking system for a hoisted structure guided along a guide rail, the braking system comprising:

a brake member having a brake surface configured to frictionally engage the guide rail, the brake member moveable between a braking position and a non-braking position; and a brake member actuation mechanism operatively coupled to the brake member and configured to actuate the brake member from the non-braking position to the braking position, the brake member actuation mechanism comprising:

an electromechanical actuator operatively coupled to a frame of the hoisted structure; and a link device having a first end and a second end, one of the first end and the second end disposed closer in proximity to the brake member, the other of the first end and the second end coupled to the electromechanical actuator, the link device remaining coupled to the brake member and the electromechanical actuator during all operating conditions, including in the braking position to control the braking force applied on the hoisted structure by the frictional engagement between the guide rail and the brake member, the braking force controlled based on an electric current provided to the electromechanical actuators;

wherein the brake member actuation mechanism is disposed in sliding contact with the guide rail.

2. The braking system of claim 1, wherein the electromechanical actuator comprises a solenoid.

3. The braking system of claim 2, wherein the link device is a coupling spring.

4. The braking system of claim 1, wherein the brake member actuation mechanism is biased into contact with the guide rail with a biasing spring.

5. The braking system of claim 1, further comprising a coupling spring disposed between the brake member and a frame structure disposed proximate the electromechanical actuator.

6. The braking system of claim 1, wherein the electromechanical actuator is in operative communication with a speed monitoring device configured to detect an overspeed condition of the hoisted structure.

7. The braking system of claim 6, wherein the speed monitoring device comprises at least one of an optical sensor and an accelerometer, wherein the brake member actuation mechanism actuates the brake member upon detection of the overspeed condition.

8. The braking system of claim 1, further comprising a biasing spring surrounding at least a portion of the link device.

9. The braking system of claim 1, wherein the brake member comprises a moveable wedge member disposed between the guide rail and a fixed wedge member, wherein the moveable wedge member and the fixed wedge member each comprise an angled surface disposed in close proximity to each other and oriented at complementary angles.

10. The braking system of claim 9, wherein the angled surface of the moveable wedge member comprises 20 degrees.

11. The braking system of claim 9, further comprising a plurality of wedge rollers disposed between the moveable wedge member and the fixed wedge member.

* * * * *